US008863317B2

(12) United States Patent
Tsuru et al.

(10) Patent No.: US 8,863,317 B2
(45) Date of Patent: Oct. 21, 2014

(54) WORK GLOVE

(75) Inventors: Takato Tsuru, Kurume (JP); Tsuyoshi Takeshita, Kurume (JP)

(73) Assignee: Towa Corporation Ltd., Fukuoka (JP)

( * ) Notice: Subject to any disclaimer, the term of this patent is extended or adjusted under 35 U.S.C. 154(b) by 0 days.

(21) Appl. No.: 13/703,571

(22) PCT Filed: Jun. 7, 2011

(86) PCT No.: PCT/JP2011/063010

§ 371 (c)(1), (2), (4) Date: Dec. 11, 2012

(87) PCT Pub. No.: WO2011/158696

PCT Pub. Date: Dec. 22, 2011

(65) Prior Publication Data

US 2013/0086731 A1 Apr. 11, 2013

(30) Foreign Application Priority Data

Jun. 15, 2010 (JP) ..... 2010-135942

(51) Int. Cl.

*A41D 19/015* (2006.01)
*A41D 31/00* (2006.01)
*A41D 19/00* (2006.01)

(52) U.S. Cl.

CPC ..... *A41D 19/015* (2013.01); *A41D 31/0072* (2013.01); *A41D 19/01558* (2013.01)
USPC ..... 2/161.6; 2/161.1; 2/167; 2/169

(58) Field of Classification Search

CPC ..... B32B 27/12; B32B 25/10; B32B 5/26; B32B 17/02; B32B 2437/02; B32B 5/024; B32B 1/00; B32B 2319/00; B32B 2571/00; B32B 25/00; B32B 25/02; B32B 25/04; A41D 19/0058; A41D 19/0062; A41D 19/01547; A41D 31/005; A41D 31/0061; A41D 19/0055; A41D 19/0065; A41D 2400/80; A41D 19/01558; A41D 19/015; A41D 31/0027

See application file for complete search history.

(56) References Cited

U.S. PATENT DOCUMENTS 2,393,298 A * 1/1946 De Laney et al. ..... 2/168
4,329,312 A * 5/1982 Ganz ..... 264/306

(Continued)

FOREIGN PATENT DOCUMENTS

JP 3161501 7/1991
JP 2006-2319 1/2006

(Continued)

OTHER PUBLICATIONS

PCT/JP2011/063010 International Search Report, mailed Jul. 12, 2011, 4 pgs.—English; 3 pgs.—Japanese.

(Continued)

*Primary Examiner* — Bobby Muromoto, Jr.
(74) *Attorney, Agent, or Firm* — Andrew F. Young, Esq.; Lackenbach Siegel, LLP

(57) ABSTRACT

Provided is a work glove which has further improved wear resistance and workability while ensuring functions such as dielectric breakdown strength and water proofing. In such a work glove, a fabric material, which is formed of one selected from cloth, knitted fabric and meshed fabric and has a predetermined area, is affixed to an outer surface of a glove base which is made of an elastic material, and a coating film having a higher friction coefficient than the fabric material is formed on a surface of the fabric material.

20 Claims, 6 Drawing Sheets

(56) References Cited

U.S. PATENT DOCUMENTS

| | | | | |
|---|---|---|---|---|
| 4,454,611 | A * | 6/1984 | Tschirch et al. | 2/8.1 |
| 4,497,072 | A * | 2/1985 | Watanabe | 2/169 |
| 5,070,540 | A * | 12/1991 | Bettcher et al. | 2/2.5 |
| 5,384,083 | A | 1/1995 | Dawn et al. | |
| 5,581,812 | A | 12/1996 | Krocheski | |
| 6,440,498 | B2 * | 8/2002 | Schaller | 427/261 |
| 7,771,644 | B2 * | 8/2010 | Flather et al. | 264/307 |
| 8,387,167 | B2 * | 3/2013 | Matsunobu et al. | 2/161.1 |
| 2002/0073474 | A1 * | 6/2002 | Geng | 2/16 |
| 2004/0010838 | A1 | 1/2004 | Wren | |
| 2004/0115439 | A1 * | 6/2004 | Degroote | 428/423.1 |
| 2006/0065353 | A1 * | 3/2006 | Williams | 156/212 |
| 2006/0070167 | A1 * | 4/2006 | Eng et al. | 2/168 |
| 2006/0130212 | A1 * | 6/2006 | Kishihara | 2/161.6 |
| 2006/0218697 | A1 * | 10/2006 | Modha et al. | 2/161.7 |
| 2007/0031601 | A1 * | 2/2007 | Williams | 427/282 |
| 2008/0020678 | A1 * | 1/2008 | Miekka et al. | 451/28 |
| 2008/0090506 | A1 * | 4/2008 | Palushaj | 451/538 |
| 2008/0109933 | A1 * | 5/2008 | Dolenak | 2/159 |
| 2008/0235850 | A1 | 10/2008 | Cabany et al. | |
| 2009/0077713 | A1 | 3/2009 | Saunders et al. | |
| 2010/0037364 | A1 | 2/2010 | Saunders et al. | |
| 2010/0050319 | A1 * | 3/2010 | Fujihana et al. | 2/161.1 |
| 2010/0095428 | A1 | 4/2010 | Fisher | |
| 2011/0138523 | A1 * | 6/2011 | Layson et al. | 2/458 |

FOREIGN PATENT DOCUMENTS

| | | | |
|---|---|---|---|
| JP | 2006 002319 | 1/2006 | |
| JP | 2007070746 | 3/2007 | |
| JP | 5065448 | 8/2012 | |
| WO | WO 95/26650 | 10/1995 | |
| WO | WO 2008123356 A1 * | 10/2008 | B29C 59/02 |

OTHER PUBLICATIONS

JP 2010-135942, Decision to Grant a Patent drafted Jul. 2, 2012, 2 pages—full certified English translation; and original JP version 3pgs.

Granted Claims of Japaense Patent No. 5065448, 1 page—English.

JP 2010-135942, Second Argument filed Jun. 11, 2012, 7 pages—full certified English translation; and original JP version 3 pgs.

JP 2010-135942, Second Amendment filed Jun. 11, 2012, 7 pages—full certified English translation; and original JP version 3 pgs.

JP 2010-135942, Second Notification of Reasons for Refusal mailed Apr. 10, 2012, 4 pages—full certified English translation; and original JP version 2 pgs.

JP 2010-135942, First Argument filed Jan. 16, 2012, 12 pages— full certified English translation; and original JP version 4 pgs.

JP 2010-135942, First Amendment filed Jan. 16, 2012, 7 pages—full certified English translation; and original JP version 3 pgs.

JP 2010-135942, First Notification of Reasons for Refusal mailed Nov. 15, 2012, 8 pages—full certified English translation; and original JP version 4 pgs.

JP 2010-135942, Explanation of Circumstances Concerning Accelerated Examination filed Oct. 15, 2012, pages—full certified English translation; and original JP version 3 pgs.

Verification of Acuracy of Translation dated Dec. 6, 2012, 1pg.

EP Appln. Serial No. 11795604.4 Search Report mailed Oct. 22, 2013, 5 pages—English.

* cited by examiner (a)

(b)

(a)

(b)

WORK GLOVE

CROSS REFERENCE TO RELATED APPLICATIONS

This application claims priority to International Ser. No. PCT/JP2011/063010 filed Jun. 7, 2011, the entire contents of which are incorporated herein fully by reference. which in turn claims priority to JP Ser. No. JP 2010-135942, filed on Jun. 15, 2010.

TECHNICAL FIELD

The present invention relates to a work glove.

BACKGROUND OF THE INVENTION

Conventionally, a number of functions corresponding to characteristics of works are imparted to a work glove.

For example, dielectric breakdown strength is an indispensable physical property for a work glove used in an electric work or the like. Further, the work glove is required to possess other properties such as fingertip workability, slip preventing property, water proofing property and the like.

For forming the work glove possessing such properties, as an example, there has been known a glove where a surface of a base glove formed of a cloth or a knitted fabric is coated with elastic materials in plural layers (for example, see patent literature 1).

However, such a glove has a possibility that, as the glove is repeatedly used, the elastic material on a surface of the glove is worn so that the coating thickness becomes small whereby a crack or a pin hole is formed in the glove.

In view of the above, there has been proposed a work glove which is configured such that, out of a plurality of layers formed of resilient members coating a surface of a base glove, a colored layer is formed below a surface layer and, when the resilient member is worn, the colored layer is exposed thus allowing a workman to visually recognize the wear (for example, see patent literature 2).

With the use of the work glove having the colored layer, the wear of a coating layer can be detected before a crack or a pin hole is formed and hence, an electrical shock accident or the like can be prevented in advance.

PRIOR ART LITERATURES

Patent Literature

Patent literature 1: JP-A-03-161501
Patent literature 2: JP-A-2000-328329

DISCLOSURE OF THE INVENTION

Task to be Solved by the Invention

However, the above-mentioned conventional work glove has been developed for allowing a user to recognize a worn state of a coating layer, and the improvement of wear resistance is not taken into account and hence, the work glove is less than optimum as a solution to overcome the above-mentioned drawbacks fundamentally.

At a site where an electric work or the like is done, there may be a case where a leather-made glove or a non-woven-fabric-made glove is mounted on the above-mentioned conventional work glove in an overlapping manner thus overcoming the problem on wear resistance.

However, in such a method, the leather-made glove or the non-woven-fabric-made glove which is mounted on an elastic glove in an overlapping manner cannot sufficiently follow the shape of the elastic glove and hence, workability is extremely lowered thus remarkably deteriorating an operational efficiency. Further, mounting and dismounting of the glove also become more cumbersome.

The present invention has been made in view of such circumstances, and it is an object of the present invention to provide a work glove which exhibits excellent mounting and dismounting property, and has further improved wear resistance and workability while ensuring functions such as dielectric breakdown strength and a water proofing property.

Means for Solving the Task

To overcome the above-mentioned drawbacks of the prior art, according to the invention described in claim 1, a work glove is characterized in that, a fabric material which is formed of one selected from cloth, knitted fabric and meshed fabric and has a predetermined area is affixed to an outer surface of a glove base which is formed of an elastic material, and a coating film having a higher friction coefficient than the fabric material is formed on a surface of the fabric material.

The work glove according to claim 2 is, in the work glove according to claim 1, characterized in that the fabric material is affixed to at least a thumb portion and/or a forefinger portion of the glove base.

The work glove according to claim 3 is, in the work glove according to claim 2, characterized in that the fabric material is formed into a finger-bag shape.

The work glove according claim 4 is, in the work glove according to any one of claims 1 to 3, characterized in that the fabric material is affixed to at least a palm portion of the glove base.

The work glove according claim 5 is, in the work glove according to any one of claims 1 to 4, characterized in that the fabric material is formed into a glove shape, and is affixed to an outer side of the glove base by mounting.

The work glove according claim 6 is, in the work glove according to any one of claims 1 to 5, characterized in that the coating layer is formed while leaving surface irregularities formed by texture of the cloth, texture of the knitted fabric or meshes of the meshed fabric.

Advantage of the Invention

According to the invention described in claim 1, the fabric material which is formed of one selected from cloth, knitted fabric and meshed fabric and has the predetermined area is affixed to the outer surface of the glove base which is formed of an elastic material, and the coating film having a higher friction coefficient than the fabric material is formed on the surface of the fabric material. Accordingly, it is possible to provide the work glove which exhibits excellent mounting and dismounting property, and also has improved wear resistance and workability while ensuring functions such as dielectric breakdown strength and water proofing property of the portion to which the fabric material is affixed.

According to the invention described in claim 2, the fabric material is affixed to at least a thumb portion and/or a forefinger portion of the glove base. Accordingly, fingertip workability can be enhanced.

According to the invention described in claim 3, the fabric material is formed into a finger-bag shape. Accordingly, fingertip workability can be enhanced, and the fabric material can be affixed to the glove base more easily.

According to the invention described in claim 4, the fabric material is affixed to at least a palm portion of the glove base. Accordingly, wear resistance and workability on a palm portion can be enhanced.

According to the invention described in claim 5, the fabric material is formed into a glove shape, and is affixed to an outer side of the glove base by mounting. Accordingly, in addition to the prevention of wear at a fingertip portion or a palm portion where an abrasion amount is large, wear generated along with bending movement of a proximal portion of a finger or the like can be prevented in a broad range.

According to the invention described in claim 6, the coating layer is formed while leaving surface irregularities formed by texture of the cloth, texture of the knitted fabric or meshes of the meshed fabric. Accordingly, a frictional force between an object to be grabbed and the work glove can be increased thus further enhancing workability.

BEST MODE FOR CARRYING OUT THE INVENTION

Figure 1:
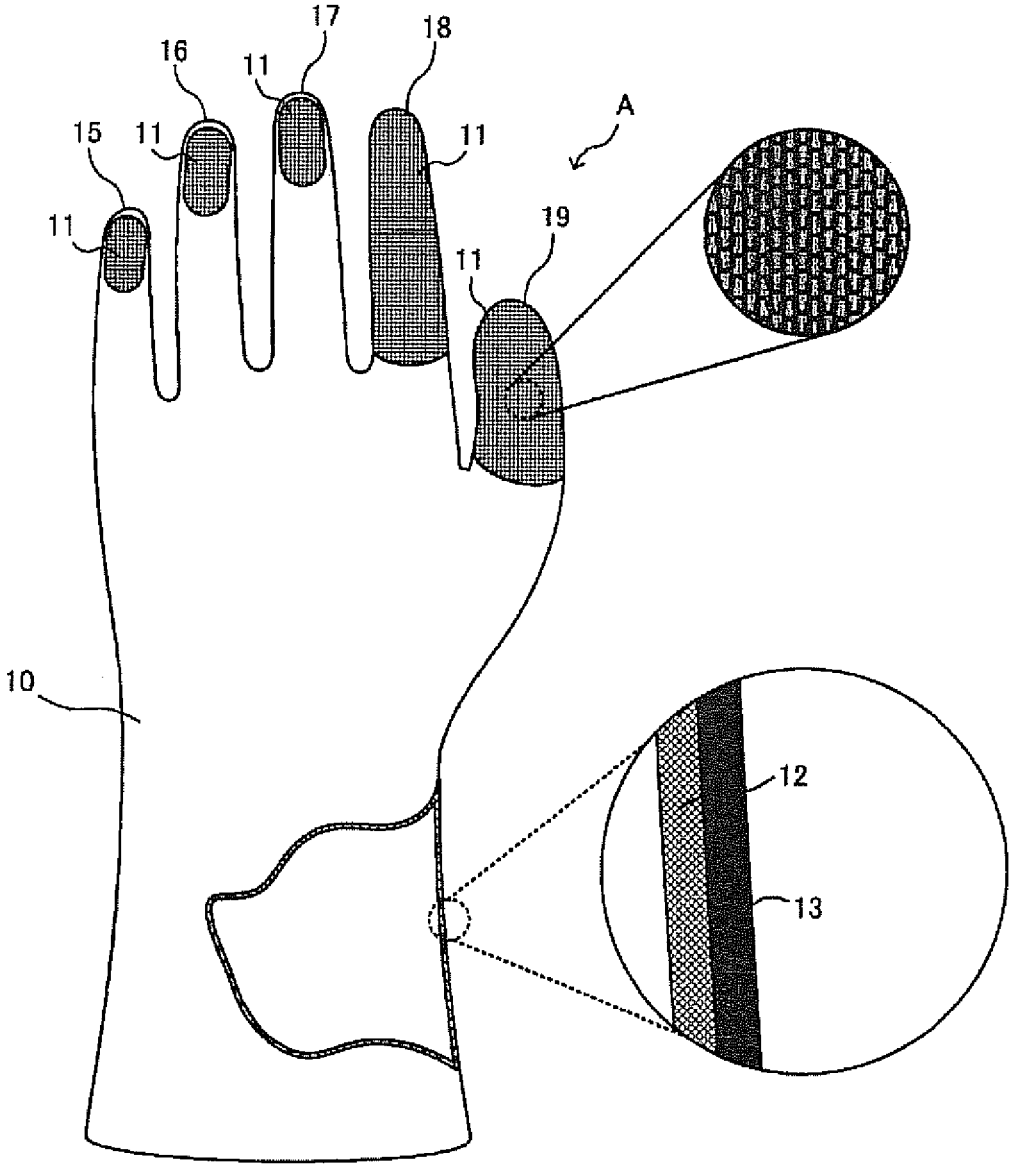
FIG. 1 An explanatory view showing a palm side of a work glove according to an embodiment.

The present invention provides a work glove which is characterized in that fabric material which is formed of one selected from cloth, knitted fabric and meshed fabric and has a predetermined area is affixed to an outer surface of a glove base which is formed of an elastic material, and a coating film having a higher friction coefficient than the fabric material is formed on a surface of the fabric material.

The usage of a work glove according to this embodiment is not particularly limited. That is, although the work glove according to this embodiment can maintain dielectric breakdown strength while exhibiting excellent wear resistance and workability at the time of performing an electric work as described above, the work glove functions as an excellent work glove also in other usages.

To refer to more specific usages, for example, the work glove according to this embodiment can exhibit excellent functions also in a fishery operation. In the case of a work glove used in fishery, a fisherman uses a net, a rope or the like and hence, there has been known a work glove which is made of nitrile rubber or vinyl chloride which exhibits high resistance against wear for imparting wear resistance to the work glove. Further, a fisherman handles sea water and fishes and shellfish and hence, there has been known a work glove whish is made of natural rubber or nitrile rubber having high water proofing property, piercing strength or cut resistance.

However, when the work glove is repeatedly used every day, the coating wears thus giving rise to a possibility that the work glove cannot maintain water proofing property and cut resistance.

To obviate such a possibility, a worker performs a fishery operation using a work glove where another glove is mounted on one coated glove in an overlapping manner or using a single coated work glove having a large coating thickness. However, in the same manner as the above-mentioned work glove having dielectric breakdown strength, the workability of the work glove is remarkably deteriorated so that the workability in cleaning marine products and handling fishing nets is deteriorated.

To the contrary, the work glove of this embodiment exhibits excellent wearing and removing property without requiring mounting of another glove on one glove in an overlapping manner, and possesses favorable wear resistance and comfortable workability and hence, the work can be efficiently performed even in such a case.

In this manner, the work glove of this embodiment is applicable to various applications not to mention the application to electric works and fishery works.

Here, an elastic material for forming a glove base is not particularly limited provided that the elastic material is a material used in general for forming work gloves and conforms to the purpose of a work glove to be formed. For example, natural rubber, a synthetic rubber made of EPDM (ethylene-propylene-diene) or the like, poly vinyl chloride, polyurethane or the like is named as the elastic material.

Further, the glove base may be constituted of only the above-mentioned elastic material or may have a lining material. For example, a coating made of an elastic material is formed on a surface of a base glove which is made of a cloth glove or a knitted glove thus forming a glove base body having a lining material. The glove base having such a lining material imparts a comfortable texture to the work glove when a worker puts his hand in the work glove or can increase a slip preventing property by increasing a friction between a glove and a hand. Further, since the fibers which constitute the base glove absorbs sweat, it is possible to prevent a worker from feeling stuffiness with his hand when he inserts his hand in the inside of the work glove.

Further, it is preferable that a fabric material which is affixed to the glove base is formed of a cloth, a knitted fabric, a meshed fabric or the like. Particularly, it is preferable that these fabric bodies have an aperture of a size which prevents woven meshes of the cloth, knitted meshes of the knitted fabric and meshes of the meshed fabric (these being also collectively referred to meshed portion of the fabric material) from being brought into contact with an object when a worker wears the work glove and grips the object.

A width of the aperture is, although the width may depend on a diameter of fibers used for forming a fabric material or a thickness of the fabric material, preferably approximately 100 mm square in terms of an aperture area, and is more preferably 50 mm square or less. When the width of the aperture exceeds 100 mm square, the glove base exposed on the meshed portions (coating film on the surface) is liable to be brought into contact with an object to be gripped thus giving rise to a possibility that the suppression of wear of the glove base becomes difficult. Further, by setting the width of the aperture to a value so that an aperture area becomes 50 mm square or less, the object to be gripped is exclusively brought into contact with the fabric material so that the direct contact between the object to be gripped and the glove base can be prevented thus remarkably enhancing wear resistance of the work glove.

Further, it is preferable that the meshed portions of the fabric material have an aperture of a size by which surface irregularities are formed on the fabric material when a coating film is formed on a surface of the fabric material.

The width and the area of the aperture are influenced by viscosity and composition of a coating liquid where a coating material is dispersed or dissolved and hence, it is difficult to decide unconditionally. However, the smaller the aperture, the thicker a coating liquid which adheres to a surface of the fabric material by coating becomes thus giving rise to a possibility that surface irregularities do not appear on the surface of the fabric material.

In other words, a width and an area of the aperture of the fabric material are preferably set such that the glove base exposed on the meshed portions is hardly brought into direct contact with an object to be gripped and, further, a coating film can form surface irregularities on a surface thereof along fibers and meshed portions of the fabric material.

Further, to positively define the relationship between the fabric material and the coating film in an actual use range, it is preferable to set a film thickness of the coating film to a thickness of the fabric material or less, for example. When a film thickness of the coating film exceeds a thickness of the fabric material, the coating film completely covers the surface irregularities of the fabric material so that it becomes impossible to form surface irregularities using fibers and meshed portions. Accordingly, such a film thickness is not preferable. A favorable coating film can be formed by setting the film thickness of the coating film to a value which falls within a range of 1/4 to 3/4 of the thickness of the fabric material.

Fibers which constitute the fabric material are fibers used for manufacturing work gloves in general. The fibers are not particularly limited provided that fibers can be used as a raw material which conforms to a purpose of a work glove to be formed. For example, when it is necessary to impart incombustibility to the work glove, fibers having incombustibility in fibers per se such as aramid fibers or carbon fibers are preferably used. When it is necessary to impart cut resistance to the work glove, high-strength fibers such as aramid fibers, high-strength polyethylene fibers or metal-based fibers are preferably used. When it is necessary to impart wear resistance to the fibers, aramid fibers, high-strength polyethylene fibers, polyethylene fibers, polyester fibers, cotton fibers, polyurethane fibers or rayon fibers are preferably used.

Further, when knitted fabric is used as the fabric material, although a knitting method is not particularly limited provided that the knitting method is a method which is used in general for forming a glove, mesh knitting and jersey knitting can be preferably named.

When a cloth is used as the fabric material, although weaving method of the cloth is not particularly limited provided that the weaving method is a method which is used in general for forming a cloth, plain weaving and twill weaving can be preferably named.

The coating film plays a role of affixing the fabric material to the glove base and also a role of imparting slip preventing property to a surface of the fabric material.

A coating material which forms the coating film is preferably made of a material having a higher friction coefficient than the fabric material, and more specifically, a coating material capable of forming a film having a higher friction coefficient than fibers (yarns) which constitute the fabric material is preferably used. As such a coating material, for example, a natural rubber based adhesive agent and a synthetic rubber based adhesive agent can be named.

By forming the coating film on the surface of the fabric material using such a coating material, it is possible to manufacture a work glove having excellent slip preventing property while enhancing wear resistance of the glove base by the fabric material. That is, it is possible to manufacture a work glove which satisfies both wear resistance and slip preventing property.

Further, the above-mentioned fibers which constitute the fabric material are preferably made of a material or preferably have the structure such that a coating material easily impregnates into the fibers. For example, by using short fibers (spun yarns) made of cotton, hemp, chemical fibers or the like as a raw material and the structure of the fibers, fluffs can be raised and a large amount of coating material can be impregnated into fluffs. On the other hand, filament yarns do not raise fluffs so that the impregnation of a coating material is difficult. However, by putting together or paralleling several fibers such as porous fibers, hollow fibers and irregular-shaped fibers or by using twisting, false twisting, stuffing or the like as a method for forming fibers, the fibers have the complicated structure so that spaces into which a coating material is filled can be formed easily whereby the impregnation of a coating material into fibers is facilitated.

With the use of such a raw material, a lump slip preventing body where a coating material is formed into small masses can be formed on a surface of the fabric material. Accordingly, the use of such a raw material is preferable.

This lump slip preventing body is formed in such a manner that a coating liquid adheres to fluffs on a surface of spun yarns or is infiltrated into spaces in fibers in a droplet shape and is solidified. Due to the presence of a large number of small-diameter particles having elasticity on a surface of a fabric material, slip preventing property of a work glove can be further enhanced.

A coating material impregnated into the inside of fibers can enhance durability of fibers by fixing the fibers.

Further, even when a coating film which is formed on a surface of the fibers is worn so that fiber bodies are exposed, a coating material is impregnated into the inside of the fibers and hence, slip preventing property can be maintained as much as possible.

Although an area of the fabric material which is affixed to the glove base is not particularly limited. A portion where imparting of wear resistance and slip preventing property is desirable differs for every work to be performed by using a work glove and hence, it is sufficient that the area of the fabric material has a size which allows the fabric material to cover a portion which requires wear resistance or a portion which requires the improvement of workability against slippage.

For example, by affixing the fabric material to portions of the glove base corresponding to hills of fingers, to be more specific, at least a thumb portion and/or forefinger portion of the glove base, it is possible to impart wear resistance and slip preventing property to fingertips of the glove base and hence, fingertip workability can be remarkably enhanced. Here, "affixing of the fabric material to at least a thumb portion and/or forefinger portion of the glove base" does not exclude affixing of the fabric material to portions other than the thump portion and/or the forefinger portion.

Further, the fabric material may be formed into a finger bag shape. Due to such a constitution, wear resistance and fingertip workability of the whole finger portions can be enhanced, and affixing of the fabric material to the glove base can be further facilitated.

The fabric material may be affixed to at least a palm portion of the glove base. Due to such a constitution, wear resistance and workability of the palm portion can be remarkably enhanced. Here, "affixing of the fabric material to at least a palm portion of the glove base" does not exclude affixing of the fabric material to portions other than the palm portion.

In this manner, by affixing the fabric material to the surface of the glove base differently depending on portions, wear resistance and workability of the portions to which the fabric material is affixed can be enhanced. Further, by forming the fabric material in a glove shape, and by mounting and affixing the fabric material to an outer side of the glove base, wear resistance and workability of the work glove can be enhanced in a wider range.

It is preferable that a coating layer formed on a surface of the fabric material is formed while leaving surface irregularities formed by meshed portions of the fabric material. By forming the coating layer in such a manner, it is possible to impart an excellent slip preventing effect to a surface of the formed work glove.

Particularly, it is preferable that a coating material for forming the coating layer is applied to both the fabric material and the glove base as a coating liquid in solution thus forming a coating film.

As a method for applying the coating liquid to the fabric material, coating or immersion may be adopted. When a coating liquid is applied by coating, applying of the coating liquid by coating can be realized such that the fabric material is mounted on a surface of the glove base in an overlapping manner, and the coating liquid is applied to the surface of the fabric material by blushing or spraying. The coating liquid applied by blushing or spraying is also applied to the glove base through the meshed portions of the fabric material thus applying the fabric material to the glove base.

Applying of the coating liquid by immersion can be also realized by arranging the fabric material on the surface of the glove base which is mounted on a manufacture hand mold and by immersing the fabric material into the coating liquid. Due to such immersion, the coating liquid is applied to the glove base through the meshed portion of the fabric material thus affixing the fabric material to the glove base.

It is desirable that the viscosity and the composition of a coating liquid to be applied are suitably adjusted corresponding to a method for applying the coating liquid such as spraying or immersion. To be more specific, as described previously, it is desirable to set the viscosity and the composition of the formed coating film at a level that surface irregularities can be formed along fibers and meshed portions of the fabric material.

Further, it is further desirable that the viscosity and the composition of the coating liquid are set such that the coating liquid can be impregnated into fibers which constitute the fabric material.

Due to such a coating liquid, the strength of fibers which constitute the fabric material per se can be enhanced, and slip preventing property of the fibers per se can be also enhanced.

Hereinafter, the work glove according to this embodiment is specifically explained in conjunction with drawings.

[Example 1]

FIG. 1 is an explanatory view showing a palm side of a work glove A according to this embodiment. The work glove A includes: a glove base 10 made of natural rubber which is a resilient material; and a knitted fabric 11 which is a fabric material affixed to a surface of the glove base 10.

As shown in the drawing with a part broken away, the glove base 10 is constituted by forming a natural rubber layer 13 on a surface of a base glove 12 which is formed into a glove shape by knitting and weaving. A thickness of the natural rubber layer 13 is set to a thickness which substantially allows the work glove A to have dielectric breakdown strength.

On the other hand, the knitted fabric 11 is formed by knitting and weaving aramid fibers (spun yarns), and is affixed to an outer surface of a little finger portion 15, an outer surface of a ring finger portion 16, an outer surface of a middle finger portion 17, an outer surface of a forefinger portion 18 and an outer surface of a thumb portion 19 of the glove base 10 respectively.

Particularly, in the work glove A according to this embodiment, with respect to the knitted fabric 11 which is affixed to the little finger portion 15, the ring finger portion 16 and the middle finger portion 17 respectively, the knitted fabric 11 is affixed to a hill of each finger, and an area of the knitted fabric 11 is set substantially equal to an area of the hill of each finger.

The knitted fabrics 11 affixed to the forefinger portion 18 and to the thumb portion 19 respectively are formed into a finger bag shape, and an area of the knitted fabric 11 which is affixed to each finger is set so as to substantially cover the whole finger.

Figure 2:
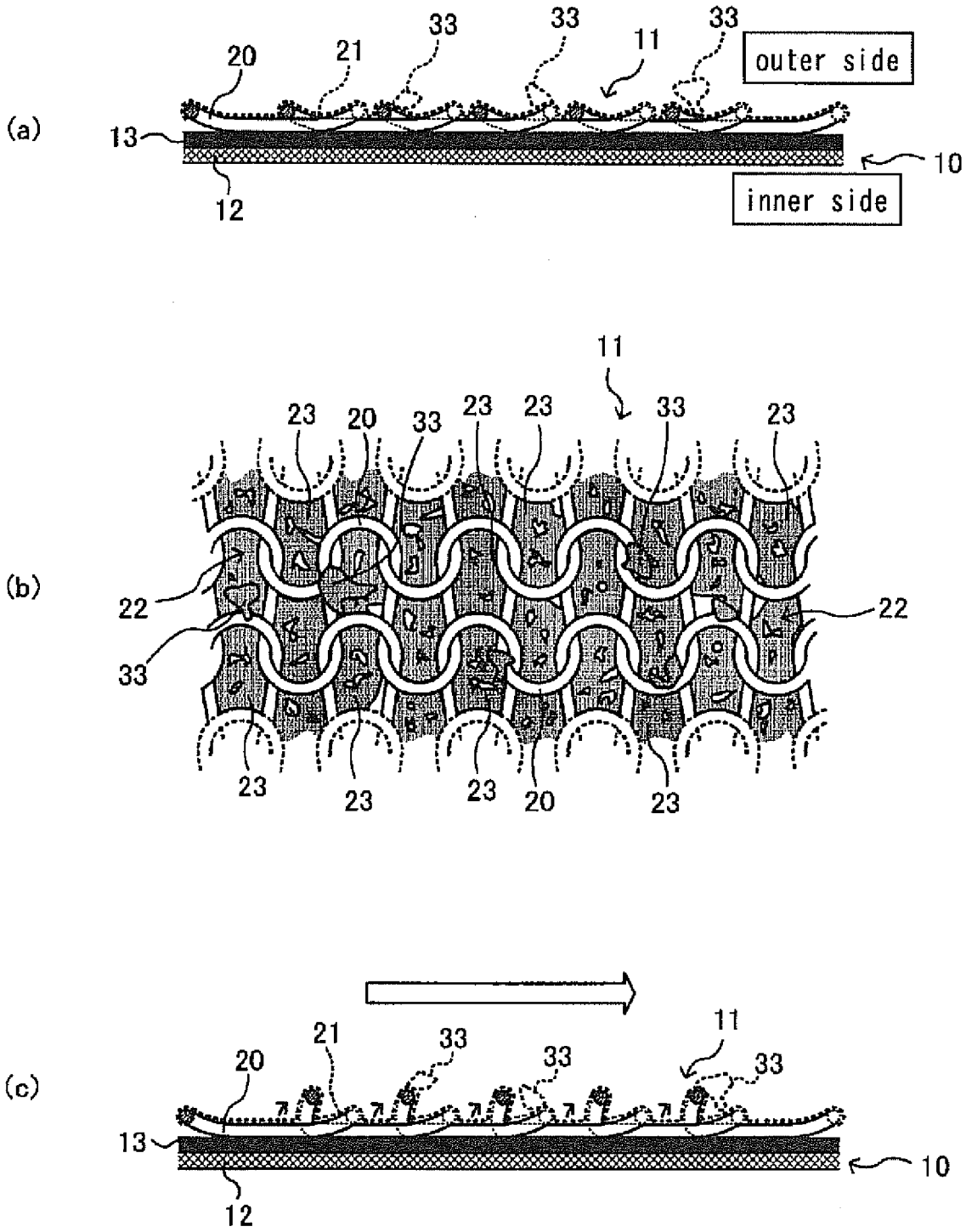
FIG. 2 An explanatory view showing the constitution of the work glove according to the embodiment.

A cross section of the part to which the knitted fabric 11 is affixed in this manner is shown in FIG. 2(*a*). The base glove 12, the natural rubber layer 13, and the knitted fabric 11 are overlapped to each other from an inner side to an outer side of the work glove A. As indicated by a broken line in the drawing, on a surface of the knitted fabric 11, a coating film 21 is formed along surface irregularities formed by knitted stitches 22 of the knitted fabric 11.

The coating film 21 is formed by adhering a natural-rubber-latex based adhesive agent as a coating material, and plays a role of an adhesive agent which affixes the knitted fabric 11 to the glove base 10. Due to such a constitution, in the part of the glove base 10 to which the knitted fabric 11 is affixed, a surface of the natural rubber layer 13 is covered with the knitted fabric 11 in a net-like shape and hence, the part is protected from wear, piercing or the like.

Accordingly, wear resistance of the part of the work glove A to which the knitted fabric 11 is affixed can be enhanced.

The coating film 21 covers a surface of the knitted fabric 11 and imparts a slip preventing property to the surface of the knitted fabric 11. Particularly, in the work glove A according to this embodiment, the coating film is formed of a natural-rubber-latex based adhesive agent which has a higher friction coefficient than a fiber body 20 made of aramid fibers and hence, a slip preventing property can be further imparted to the part of the work glove A to which the knitted fabric 11 is affixed.

As shown in FIG. 2(*b*), a portion of the coating film 21 forms a meshed portion film body 23 having a thin film shape using a knitted stitch 22 of the knitted fabric 11. In FIG. 2(*b*), to clearly show the meshed portion film body 23, the coating film 21 formed on the fiber body 20 is omitted from the drawing.

On the fiber body 20, lump resilient bodies 33 which are formed of a coating liquid adhering to short fibers of the aramid fibers in a droplet shape are formed.

The work glove A having such a constitution generates a large frictional force with respect to an object gripped by fingertips of the glove A and hence, a slip preventing property of the fingertips is enhanced. Further, as shown in FIG. 2(*c*), when a frictional force acts in the direction indicated by a voided arrow, the fiber body 20 is raised so that the lump resilient bodies 33 are also entangled with the object thus further increasing a frictional force of the fingertip.

Some meshed portion film bodies 23 will, along with the use of the work glove A, be slightly peeled off while being affixed to the glove base 10. The peeled-off portions generate a frictional force with respect to the gripping object and hence, the lowering of slip preventing property which is brought about by the use of the work glove A can be prevented as much as possible.

Since the fiber body 20 is covered with the coating film 21, when the frictional force is eliminated after the fiber body 20 is raised, the fiber body 20 is returned to an original state shown in FIG. 2(*a*) again due to a resilient force of the coating film 21 and hence, it is possible to prevent the generation of fluffs as much as possible.

Figure 3:
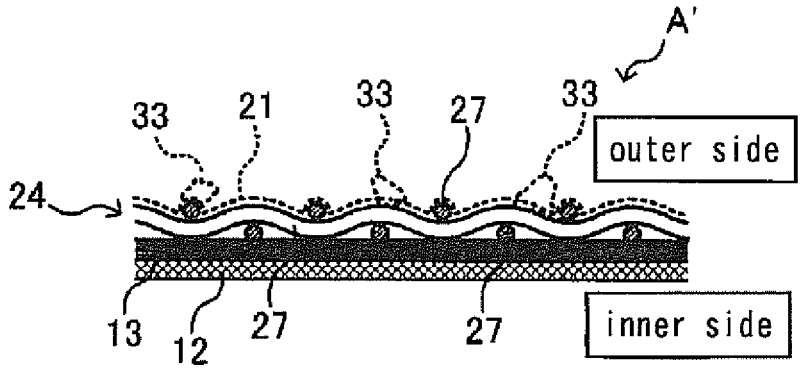
FIG. 3 An explanatory view showing the constitution of a work glove according to a modification.
Figure 3:
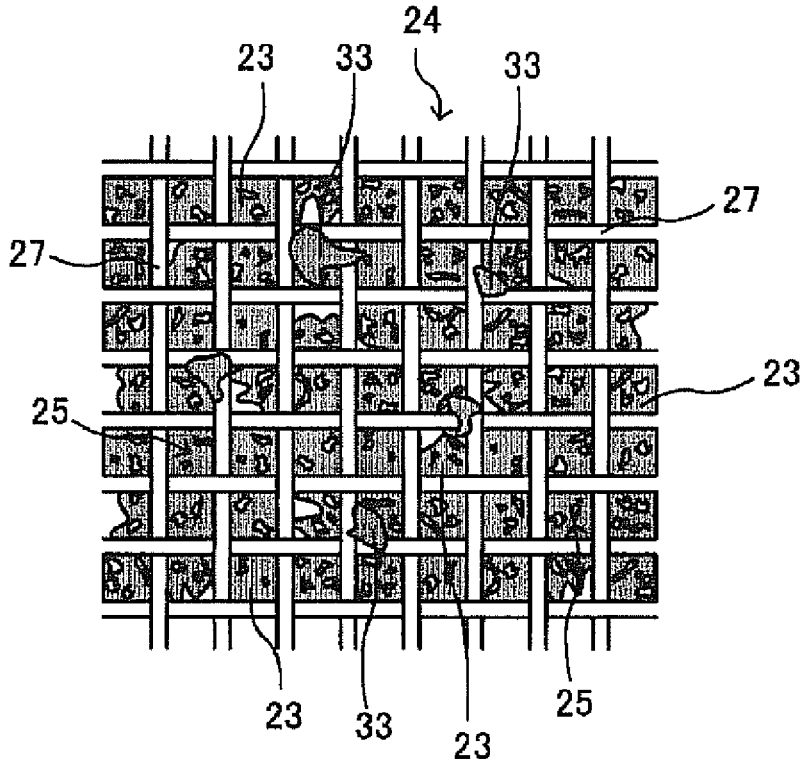

In the work glove A according to this embodiment, the knitted fabric 11 is used as a fabric material. However, a cloth may be used in place of the knitted fabric 11. FIG. 3(*a*) shows the cross-sectional structure of a work glove A' according to a modification where a cloth 24 is affixed to the surface of the glove base 10.

As shown in the drawing, a base glove 12, a natural rubber layer 13, and the cloth 24 are overlapped to each other from an inner side to an outer side of the work glove A'. On a surface of the cloth 24, as indicated by a broken line in the drawing, a coating film 21 is formed along surface irregularities formed by a weave pattern 25 of the cloth 24.

As shown in FIG. 3(*b*), lump resilient bodies 33 are formed on fibers 29 of the cloth 24.

Due to such a constitution, in the same manner as the work glove A having the above-mentioned knitted fabric 11, it is possible to manufacture the work glove A' having excellent wear resistance and excellent workability.

Figure 4:
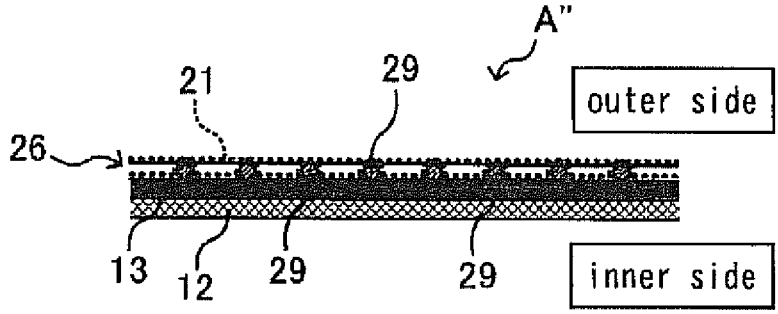
FIG. 4 An explanatory view showing the constitution of the work glove according to the modification.
Figure 4:
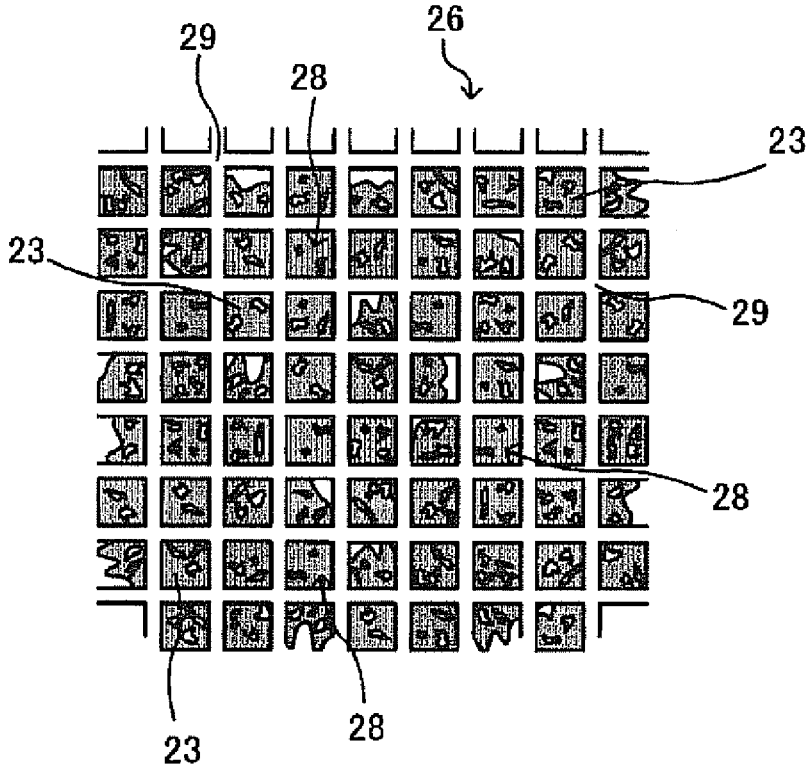
Figure 5:
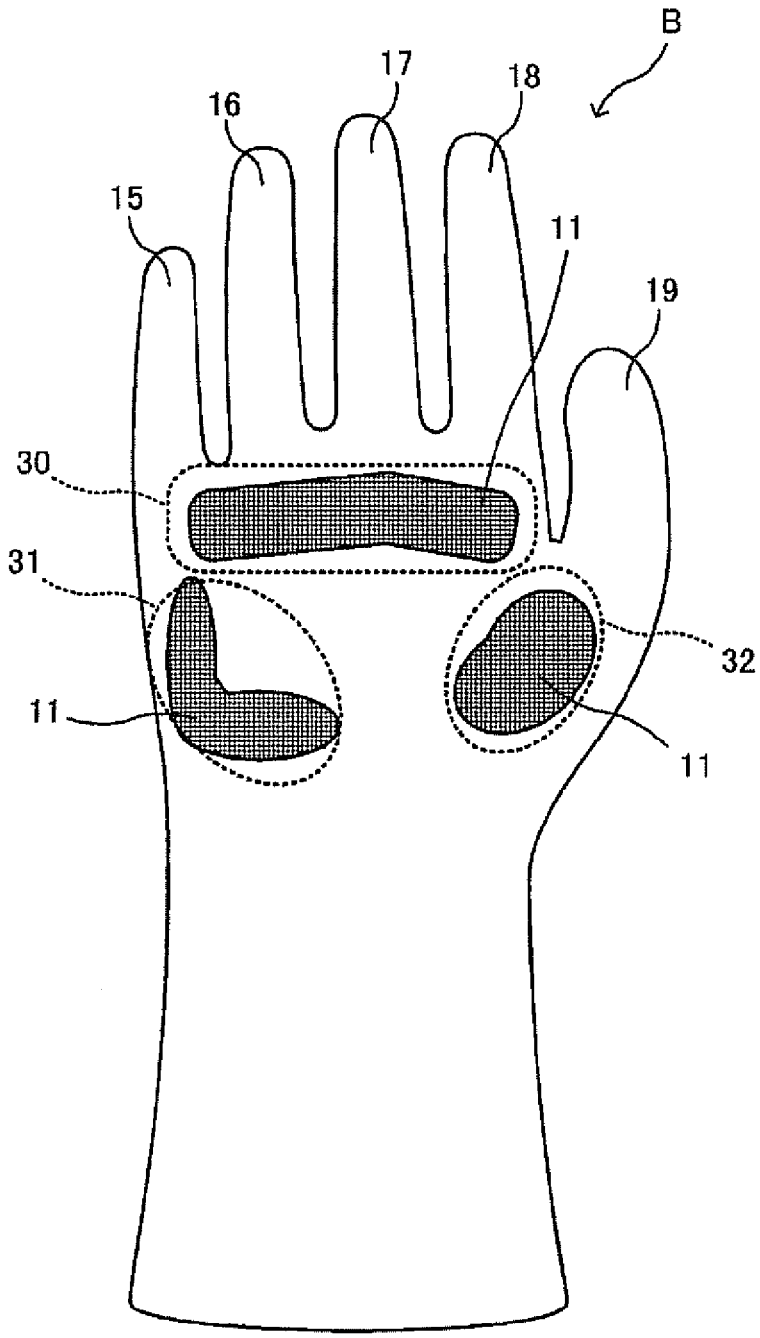
FIG. 5 An explanatory view showing a palm side of a work glove according to another embodiment.

As another modification, as the fabric body which is affixed to the glove base 10, a meshed fabric 26 may be used in place of the knitted fabric 11 or the cloth 24. FIG. 4(*a*) shows the cross-sectional structure of a work glove A" according to another modification where the meshed fabric 26 is affixed to the surface of the glove base 10.

As shown in the drawing, a base glove 12, a natural rubber layer 13, and the meshed fabric 26 are overlapped to each other from an inner side to an outer side of the work glove A". On a surface of the meshed fabric 26", as indicated by a broken line in the drawing, a coating film 21 is formed along surface irregularities formed by meshes 28 of the meshed fabric 26.

As shown in FIG. 4(*b*), a meshed portion film body 23 is formed between fibers 29 in the meshes 28 of the meshed fabric 26.

Due to such a constitution, it is possible to manufacture the work glove A" having excellent wear resistance and excellent workability in the same manner as the work glove A having the above-mentioned knitted fabric 11 or the work glove A' having the above-mentioned cloth 24. In this modification, filament yarns are used for forming the meshed fabric so that fuzz is formed a little and hence, lump resilient bodies 33 are not formed. It is needless to say, however, that the lump resilient bodies 33 may be formed on a surface of the work glove by using a meshed fabric formed of spun yarns or twisted yarns.

[Example 2]

Next, an example 2 is explained. While the fabric material is affixed to the respective finger portions in the work glove A described in the above-mentioned example 1, a work glove B according to this example 2 is characterized in that a fabric material is affixed to a palm portion of the work glove 13. In the explanation made hereinafter, constitutional parts substantially equal to the constitutional parts of the above-mentioned example are given same symbols and the explanation of these constitutional parts is omitted.

In the work glove B, to be specific, the meshed fabric 11 is affixed to a four-finger palm position 30, a little finger hill position 31, and a thumb hill position 32.

According to the work glove B having such a constitution, it is possible to remarkably enhance wear resistance and a slip preventing property of the palm portion of the work glove B. It is needless to say that, in the same manner as the above-mentioned work glove A, also in the work glove B, in place of the knitted fabric 11, a cloth 24 or a meshed fabric 26 may be affixed to the palm portion, or a mixed body formed of the cloth 24 and the meshed fabric 26 may be affixed to the palm portion.

[Example 3]

Figure 6:
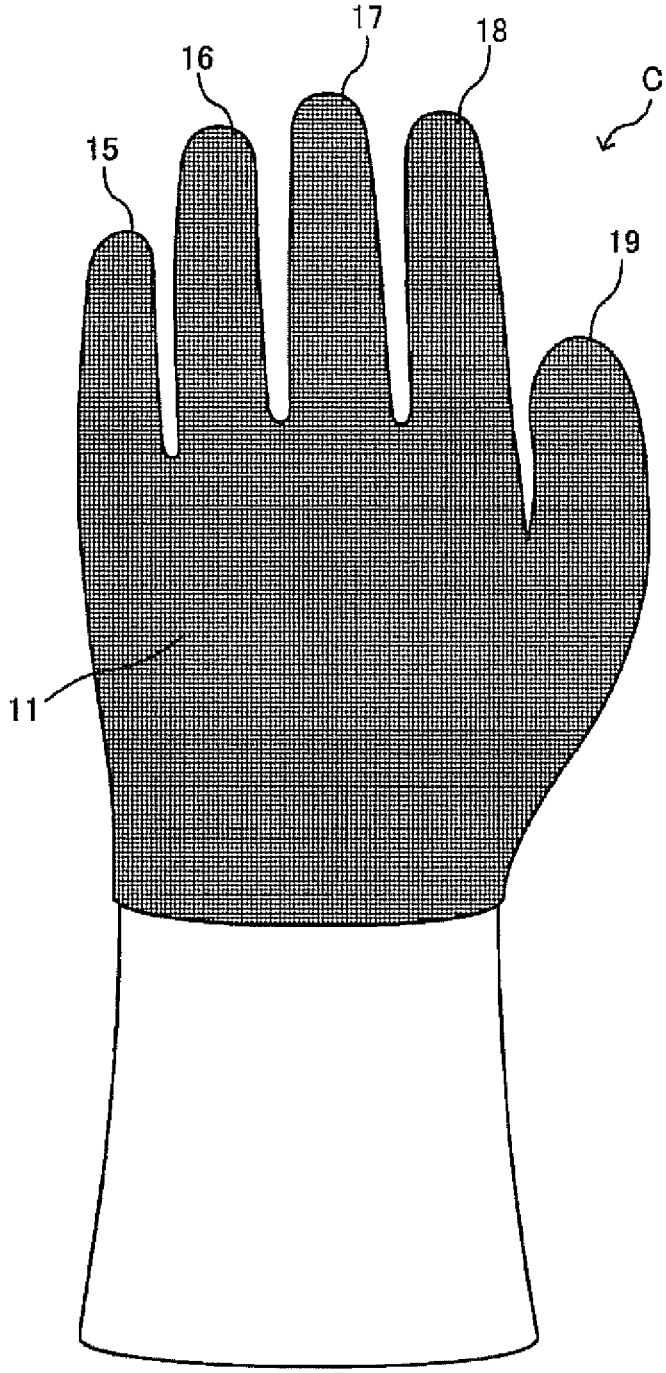
FIG. 6 An explanatory view showing the palm side of the work glove according to another embodiment.

Next, a work glove C according to an example 3 is shown in FIG. 6. The work glove C is characterized in that a fabric material is formed into a glove shape, and is mounted on and affixed to a glove body 10.

According to the work glove C having such a constitution, it is possible to enhance a slip preventing property of the whole hand including respective finger portions and a palm portion of the glove body 10. In such a constitution, in the case where a slip preventing property is unnecessary on a back of the work glove C, a fabric material formed into a glove shape having no back portion may be used. It is needless to say that, in the same manner as the above-mentioned work gloves A and B, also in the work glove C, in place of the knitted fabric 11, a cloth 24 or a meshed fabric 26 may be affixed to the glove body 10, or a mixed body formed of the cloth 24 and the meshed fabric 26 may be affixed to the glove body 10.

Next, an example of the manufacture of the work glove according to this embodiment is explained by taking the work glove C explained in conjunction with the example 3 as an example.

[Example of Manufacture]

A 15 gauge nylon glove is mounted on a manufacture hand mold, the nylon glove is immersed into a coagulant (10% calcium nitrate/methanol solution), is pulled up from the solution, is dried at a temperature of 60° C. for 2 minutes and, thereafter, is immersed in an NR latex blended liquid (NR latex: 100 phr, sulfur: 1 phr, EZ 1 phr, zinc oxide: 1 phr).

The nylon glove was dried at a temperature of 90° C. for 30 minutes thus forming a glove base. A 10 gauge aramid fiber glove is mounted on the glove base as a glove-shaped fabric material. Then, the glove base is immersed into a coating liquid (the above-mentioned blended liquid: 100 phr, MG latex: 50 phr, water: 50 phr, solid component: 40%, viscosity: 30 cps). The glove base is pulled up from the coating liquid and, thereafter, is dried at a temperature of 90° C. for 30 minutes, and subsequently, the drying and crosslinking are performed at a temperature of 110° C. for 30 minutes. After removing the glove from the mold, the glove is washed with water at a temperature of 60° C. for 4 hours and, then, is dried at a temperature of 100° C. for 1 hour thus manufacturing a work glove C according to this embodiment. A thickness of the aramid fiber glove which constitutes the work glove C of this example is 600 μm, and a thickness of a formed coating film is 200 μm.

Next, to carry out a performance comparison test of the work glove C manufactured by the above-mentioned manufacture example, a comparison glove which becomes a control is manufactured.

[Comparison Glove P]

A coating agent is applied to a glove base by coating, and an aramid fiber glove is mounted on and affixed to the glove base thus manufacturing a comparison glove P. The comparison glove P differs from the work glove C with respect to a point that a coating film is not formed on a surface of a fabric material (aramid fiber glove).

[Comparison Glove Q]

A glove base to which a fabric material is not affixed is manufactured as a comparison glove Q.

[Wear Resistant Test]

Next, a slip preventing property test is carried out on the work glove C according to this embodiment and the comparison gloves P, Q. The slip preventing property test is carried out by testing friction resistance when the glove is in a dry state.

The result of the slip preventing property test is shown in Table 1. Friction coefficients shown in Table 1 are obtained by using a surface resistance tester (spherical indenter). The friction coefficients in Table 1 indicate that the larger a numerical value of the friction coefficient, the stronger the friction resistance become so that a slip preventing function is high.

TABLE 1

| identification of glove | work glove C | comparison glove P | comparison glove Q |
|---|---|---|---|
| friction coefficient (average) | 0.46 | 0.16 | 0.28 |
| friction coefficient (maximum) | 0.56 | 0.19 | 0.36 |
| friction coefficient (minimum) | 0.4 | 0.14 | 0.24 |

As the result of this test, as also shown in Table 1, it is found that the work glove C according to this embodiment exhibits high friction coefficient thus having excellent slip preventing property compared to other comparison gloves P, Q.

[Fingertip Workability Test]

Next, a fingertip workability test was carried out on the work glove C according to this embodiment and the comparison gloves P and Q.

In a CE fingertip workability test (EN-420), for example, a state where a fingertip can grip a stainless steel pipe having a diameter of 5 mm and a length of 40 mm three times within 30 seconds is set as level 5. In the original CE fingertip workability test (EN-420), the level 5 is set as the maximum level. In this test, however, fingertip workability is tested by additionally setting company's own references ranging from level 6 to level 10. The test reference values are shown in Table 2 and the result of the test is shown in Table 3.

TABLE 2

| | level | | | | | | | | | |
|---|---|---|---|---|---|---|---|---|---|---|
| | CE EN-3881 reference | | | | | own company's reference | | | | |
| | 1 | 2 | 3 | 4 | 5 | 6 | 7 | 8 | 9 | 10 |
| diameter of stainless pipe (mm) | 11.0 | 9.5 | 8.0 | 6.5 | 5.0 | 3.0 | 2.0 | 1.0 | 0.8 | 0.5 |
| length of stainless pipe (mm) | 40 | 40 | 40 | 40 | 40 | 40 | 40 | 40 | 40 | 40 |
| weight of stainless pipe (g) | 13.2 | 5.9 | 6.2 | 3.8 | 3.3 | 0.58 | 0.39 | 0.15 | 0.09 | 0.05 |

TABLE 3

| identification of glove | work glove C | comparison glove P | comparison glove Q |
|---|---|---|---|
| CE level | 8 | 2 | 7 |

As the result of the test, the CE level of the work glove C according to this embodiment is highly evaluated compared to the comparison gloves P, Q and hence, it is found that the work glove C according to this embodiment exhibits excellent fingertip workability compared to the comparison gloves P, Q.

[Wear Resistance Test]

Next, the wear resistance is tested with respect to the work glove C according to this embodiment and the comparison glove Q using a CE Martindale test (EN388). The CE Martindale test is a testing method where the abrasion is repeatedly applied to a fabric while applying a predetermined load to the fabric using a Martindale abrasion tester, and wear resistance is evaluated based on the number of times of abrasion until the breaking of fabric occurs. The result of the test is shown in Table 4.

TABLE 4

| identification of glove | work glove C | comparison glove P | comparison glove Q |
|---|---|---|---|
| number of frictions until breakage | 4500 | 2800 | 2450 |

As shown in Table 4, the number of times of abrasion before breaking occurs is large in the work glove C according to this example compared to other comparison gloves P, Q so that it is understood that the work glove of this example has excellent wear resistance.

Further, what must be focused particularly in this test is a point that the work glove C has remarkably improved wear resistance compared to the comparison glove P having no coating film on a surface of a fabric material.

It is considered that this remarkable improvement of wear resistance is brought about not only by the difference between the presence and the non-presence of a coating film on a surface of the fabric material but also a fact that a coating liquid (coating agent) impregnated into fibers which form a fabric material plays a large role in strengthening the fibers.

That is, this test suggests that it is possible to remarkably enhance the wear resistance of the work glove C by forming a coating film on a surface of the fabric material and by impregnating a coating liquid in fibers of the fabric material.

[Cut Resistance Test]

Next, an ISO cut resistance test is carried out with respect to cut resistance on the work glove C according to this embodiment and the comparison gloves P, Q. The ISO unit (resistance test) is a test where a force required at the time of cutting (N: Newton) is measured, and the higher a value of the force, the higher the cut resistance becomes. Accordingly, it is evaluated that the cut resistance is also high. The result of the test is shown in Table 5.

TABLE 5

| identification of glove | work glove C | comparison glove P | comparison glove Q |
|---|---|---|---|
| load (N) | 7.1 | 6.5 | 2.1 |

As shown in Table 5, the work glove C according to this embodiment exhibits high cut resistance compared to other comparison gloves P, Q thus exhibiting excellent cut resistance.

The reason the work glove C exhibits excellent cut resistance compared to the glove on which only an aramid glove is mounted (comparison glove P) and the rubber glove (comparison glove Q) is considered that this advantageous effect is brought about by a synergistic effect of an elastic force of the coating film formed on the surface of the fabric material and the enhancement of an elastic force and a shearing strength brought about by a coating agent impregnated into fibers.

As described heretofore, according to the work glove of this embodiment, the fabric material which is formed of one selected from cloth, knitted fabric and meshed fabric and has the predetermined area is affixed to the outer surface of the glove base which is formed of an elastic material, and the coating film having a higher friction coefficient than the fabric material is formed on the surface of the fabric material, and the coating material is impregnated into the fabric material. Accordingly, it is possible to provide the work glove which has further improved wear resistance and workability while ensuring functions such as dielectric breakdown strength and water proofing property.

Finally, the explanation of the above-mentioned respective embodiments merely constitutes one example of the present invention, and the present invention is not limited to the above-mentioned embodiments. Accordingly, it is needless to say that various changes can be made corresponding to design or the like without departing from the technical concept of the present invention even with respect to embodiments other than the above-mentioned embodiments.

REFERENCE SIGNS LIST

10: glove base
11: knitted fabric
20: fiber body
21: coating film
22: knitted stitch
23: meshed portion film body
24: cloth
25: weave pattern
26: meshed fabric
27: fiber
28: mesh
29: fiber
30: position of palm
31: little finger hill position
32: thumb hill position
33: lump resilient body
A: work glove
B: work glove
C: work glove

The invention claimed is:

1. A work glove comprising:
a first layer directly contacting skin of a hand,
a natural rubber glove base consisting of a weaved second layer having a rubber third layer thereon,
a partial outer fourth layer consisting of a weaved laver, and
an adhesive resin material impregnated in said weaved fourth layer to provide said fourth layer with increased strength and friction.

2. The work glove according to claim 1, wherein an aperture area filled with said adhesive material of said fourth layer is less than 100 square millimeters.

3. The work glove according to claim 1, wherein the surface friction coefficient of said fourth layer is in the range of 0.35-0.65.

4. The work glove according to claim 1, wherein the surface friction coefficient of said fourth layer is greater than or equal to 0.3.

5. The work glove according to claim 1, wherein said fourth layer has a curved surface including a pattern of fibrous ridges and space filled with said adhesive resin.

6. The work glove according to claim 1, wherein a thickness of said adhesive resin is in the range of 1/4 -3/4 of a thickness of said fourth layer.

7. A work glove comprising;
a first layer directly contacting skin of a hand,
an elastic glove base consisting of a weaved second layer having an elastic third layer thereon,
a partial outer fourth layer consisting of a weaved layer, and
an adhesive resin material impregnated in said weaved fourth layer to provide said fourth layer with increased strength and friction.

8. The work glove according to claim 7, wherein said elastic third layer is made from a material selected from the group cons sting of natural rubber, synthetic rubber, polyvinylchloride and polyurethane.

9. The work glove according to claim 7, wherein an aperture area filled with said adhesive material of said fourth layer is less than 100 square millimeters.

10. The work glove according to claim 7, wherein the surface friction coefficient of said fourth layer is in the range of 0.35-0.65.

11. The work glove according to claim 7, wherein the surface friction coefficient of said fourth layer is greater than or equal to 0.3.

12. The work glove according to claim 7, wherein said fourth layer has a curved surface including a pattern of fibrous ridges and space filled with said adhesive resin.

13. The work glove according to claim 7, wherein a thickness of said adhesive resin is in the range of 1/4 -3/4 of a thickness of said fourth layer.

14. A work glove comprising;
a first layer directly contacting skin of a hand,
a rubber glove base consisting of a weaved second layer having a rubber third layer thereon,
a partial outer fourth layer consisting of a weaved layer, and
an adhesive resin material impregnated in said weaved fourth layer to provide said fourth layer with increased strength and friction.

15. The work glove according to claim 7, wherein said rubber layer is made from a material selected from the group consisting of natural rubber and synthetic rubber.

16. The work glove according to claim 14, wherein an aperture area filled with said adhesive material of said fourth layer is less than 100 square millimeters.

17. The work glove according to claim 14, wherein the surface friction coefficient of said fourth layer is in the range of 0.35-0.65.

18. The work glove according to claim 14, Wherein the surface friction coefficient of said fourth layer is greater than or equal to 0.3.

19. The work glove according to claim 14, wherein said fourth layer has a curved surface including a pattern of fibrous ridges and space filled with said adhesive resin.

20. The work glove according to claim 14, Wherein a thickness of said adhesive resin is in the range of 1/4 -3/4 of a thickness of said fourth layer.

* * * * *